United States Patent [19]

Gupta

[11] 3,948,279

[45] Apr. 6, 1976

[54] CIRCUITRY FOR COIN-HANDLING SYSTEM

[75] Inventor: Ashok K. Gupta, Hot Springs, Ark.

[73] Assignee: U.M.C. Industries, Inc., New York, N.Y.

[22] Filed: Nov. 5, 1974

[21] Appl. No.: 520,973

[52] U.S. Cl. ..... 133/1 R; 133/3 R; 133/4 R; 221/10

[51] Int. Cl.[2] ..... G07D 1/00

[58] Field of Search ..... 133/1 A, 1 R, 3 R, 4 R, 133/8 R, 8 A, 8 C, 8 D; 221/9, 10, 6, 15; 222/56, 64, 67

[56] References Cited

UNITED STATES PATENTS

| | | | |
|---|---|---|---|
| 3,107,818 | 10/1963 | Carmellini et al. | 222/67 X |
| 3,227,363 | 1/1966 | Hecker et al. | 133/3 R X |
| 3,430,808 | 3/1969 | Matthews | 221/10 |
| 3,509,979 | 5/1970 | New | 194/13 |
| 3,838,663 | 10/1974 | Focke | 221/6 X |

*Primary Examiner*—Robert B. Reeves
*Assistant Examiner*—Joseph J. Rolla
*Attorney, Agent, or Firm*—Rogers, Eilers & Howell

[57] ABSTRACT

A circuit responds to a level-sensing device, adjacent a coin-holding tube, to cause an electric motor to rotate a coin-receiving drum until sufficient coins issue from that coin-receiving drum to fill that coin-holding tube. Ordinarily, coins will issue from that coin-receiving drum in such rapid succession that the motor need not be energized very long. However if, because some coins within that coin-receiving drum interact to form a "bridge" which retards or prevents the issuance of other coins from that coin-receiving drum, or if for any other reason coins do not issue from that coin-receiving drum, the circuit will keep that motor energized for a finite length of time, will de-energize that motor, and will energize that motor for a second finite length of time. Usually, the de-energization of the motor and the succeeding energization of that motor for a finite length of time will permit the coins within the coin-receiving drum to shift sufficiently to enable coins to issue from that coin-receiving drum during that succeeding energization of that motor for a finite length of time; and, in such event, the motor will continue to rotate the coin-receiving drum until sufficient coins issue from that coin-receiving drum to fill the coin-holding tube.

21 Claims, 5 Drawing Figures

FIG. 1.
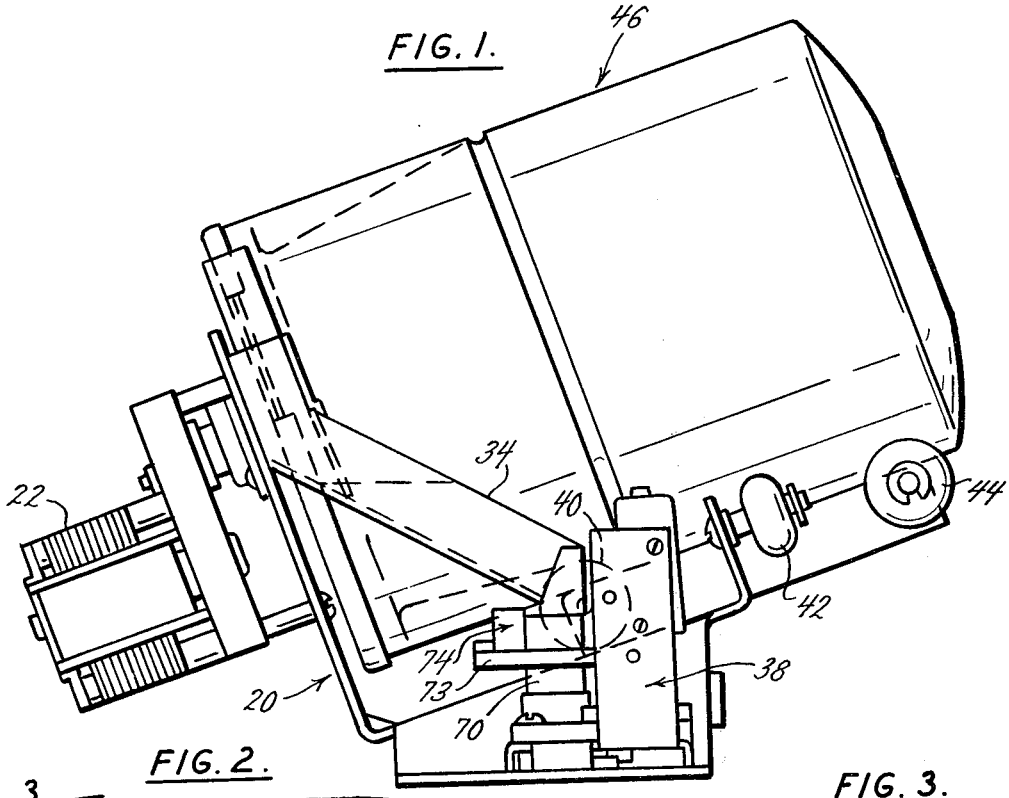
FIG. 2.
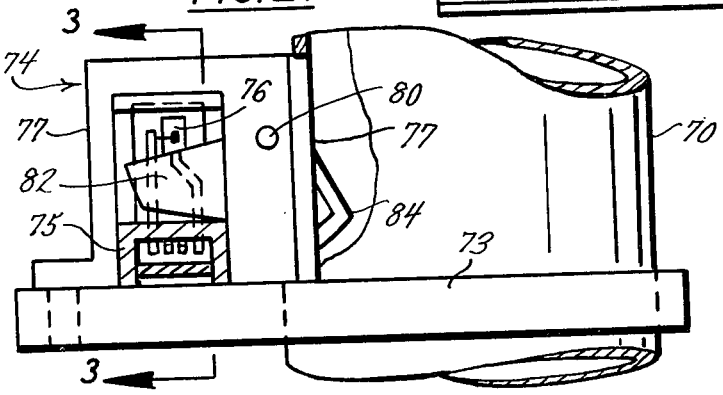
FIG. 3.
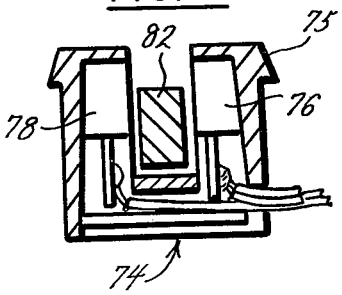
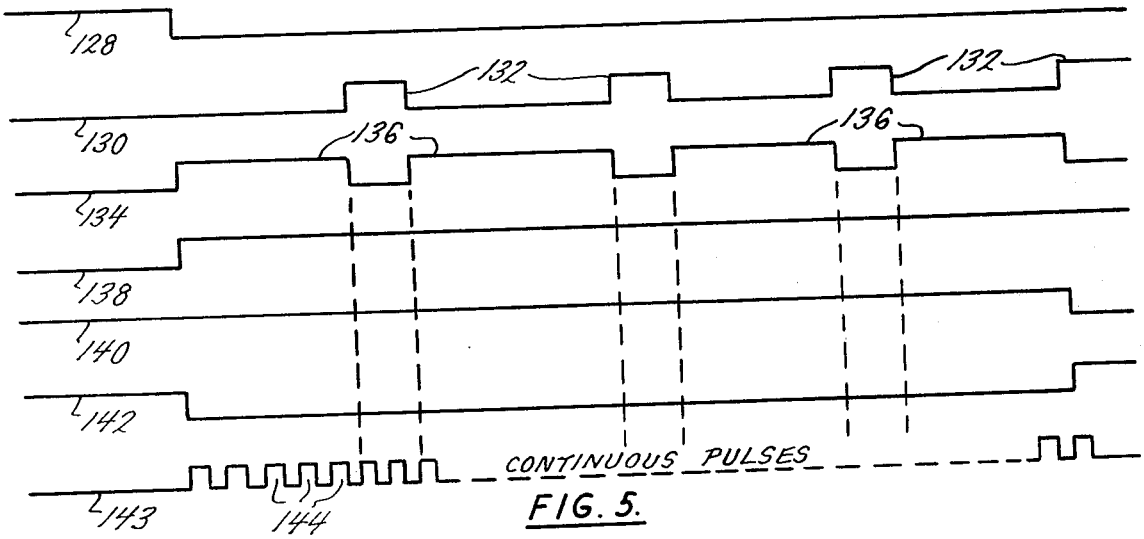
FIG. 5.

CIRCUITRY FOR COIN-HANDLING SYSTEM

BACKGROUND OF THE INVENTION

Coin-holding tubes usually have the coins therein held in stacked array; but it is time-consuming to insert coins in those coin-holding tubes by hand. As a result, coin-receiving drums have been proposed which could hold coins in random fashion, but which could respond to rotation thereof by an electric motor to orient those coins and cause them to form a stack as they entered, and came to rest within, a coin-holding tube. If the coins within any such coin-receiving drum tended to "bridge" adjacent the outlet of that coin-receiving drum and thereby tended to retard or block the issue of further coins from that coin-receiving drum; or if for any other reason coins did not issue freely from that coin-receiving drum, the motor for that coin-receiving drum would run continuously until it was shut off manually or by a suitable thermal protector or timer.

SUMMARY OF THE INVENTION

A circuit responds to a level-sensing device, adjacent a coin-holding tube, to cause an electric motor to rotate a coin-receiving drum until sufficient coins issue from that coin-receiving drum to fill that coin-holding tube. Ordinarily, coins will issue from that coin-receiving drum in such rapid succession that the motor need not be energized very long. However, if, because some coins within that coin-receiving drum interact to form a "bridge" which retards or prevents the issuance of other coins from that coin-receiving drum, or if for any other reason coins do not issue from that coin-receiving drum, the circuit will keep that motor energized for a finite length of time, will de-energize that motor, and will energize that motor for a second finite length of time. Usually, the de-energization of the motor and the succeeding energization of that motor for a finite length of time will permit the coins within the coin-receiving drum to shift sufficiently to enable coins to issue from that coin-receiving drum during that succeeding energization of that motor for a finite length of time; and, in such event, the motor will continue to rotate the coin-receiving drum until sufficient coins issue from that coin-receiving drum to fill the coin-holding tube. However, if the de-energization of the motor and the succeeding energization of that motor for a finite length of time do not permit the coins within the coin-receiving drum to shift sufficiently to enable coins to issue from that coin-receiving drum during that succeeding energization of that motor for a finite length of time, the circuit will, if necessary, de-energize the motor a second time, energize that motor for a third finite length of time, de-energize that motor a third time, and energize that motor for a fourth finite length of time. If, at the end of the fourth energization of the motor, the coin-holding tube still is not filled with coins, the circuit will de-energize that motor a fourth time, and it then will keep that motor de-energized until a service man re-sets the circuit. That circuit gives the coins, within the coin-receiving drum, ample opportunity to issue from that coin-receiving drum; but it avoids prolonged, fruitless energization of the electric motor which drives that coin-receiving drum. It is, therefore, an object of the present invention to provide a circuit which can energize the electric motor that drives a coin-receiving drum, which can successively de-energize and re-energize that motor if coins do not issue freely from the coin-receiving drum, and which can prevent prolonged, fruitless energization of that motor.

The circuit is operated at low voltage; and it can be operated successfully at such a voltage, because it uses a solid-state component in the level-sensing device thereof, and thus is free from the variable contact resistance which is inherent in the use of metal contacts. It is, therefore, an object of the present invention to provide a circuit which can be operated successfully at low voltage and which uses a solid-state component in the level-sensing device thereof.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING

In the drawing,

FIG. 1 is a side elevational view of one coin-handling unit with which the circuit of the present invention can be used, FIG. 2 is a partially-sectioned, partially-broken view, on a large scale, through a level-sensing device provided by the present invention, FIG. 3 is a sectional view, on the scale of FIG. 2, through the level-sensing device of FIG. 2, and it it taken along the plane indicated by the line 3—3 in FIG. 2, FIG. 5 shows various wave forms which are developed at specific points in the circuitry shown by the diagram of FIG. 4.

DESCRIPTION OF PREFERRED EMBODIMENT

Figure 4:
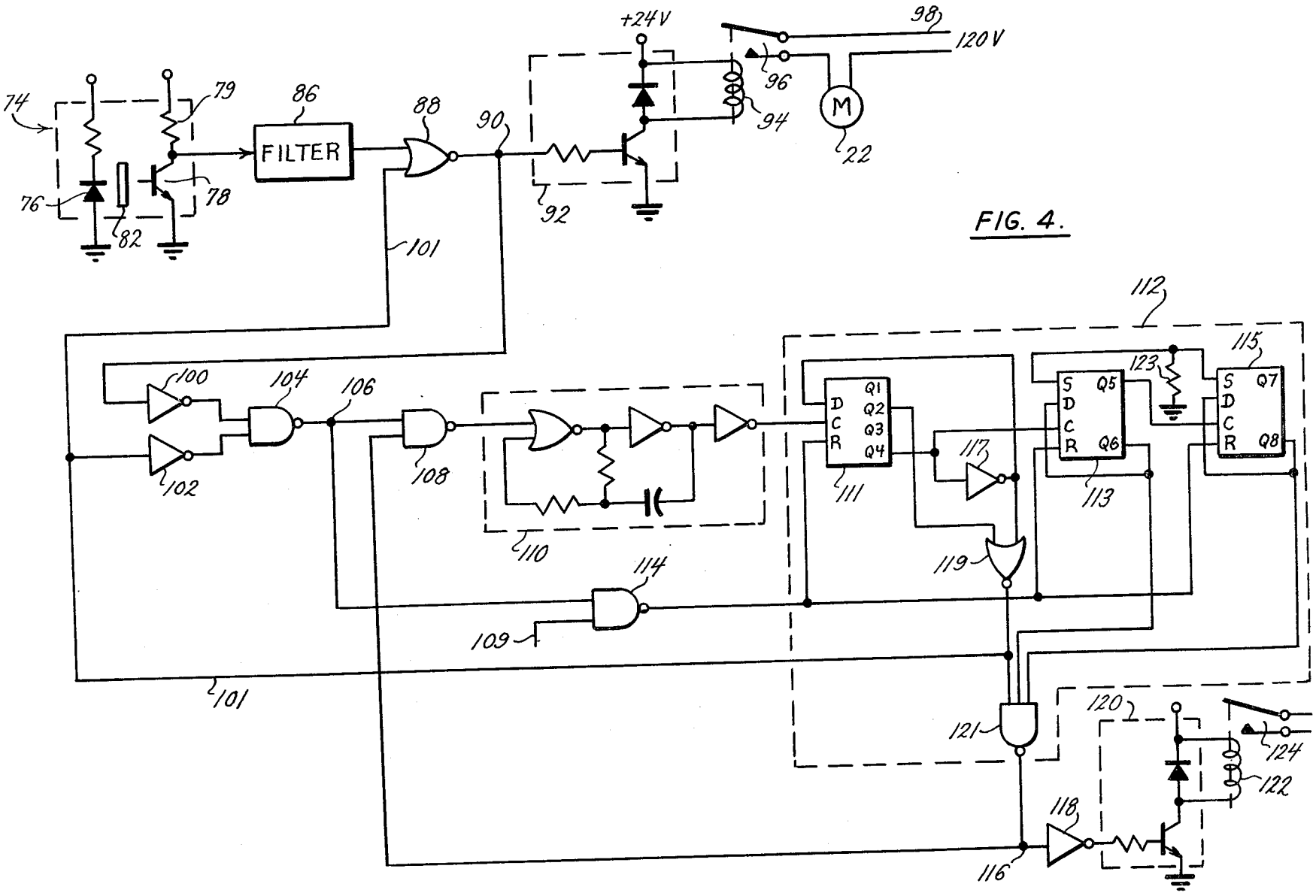
FIG. 4 is a diagram which shows the preferred embodiment of circuitry that is provided by the present invention.

Referring to the drawing in detail, the numeral 20 generally denotes the base of a coin-handling device which can be identical to the correspondingly-numbered base in Gustav F. Erickson application which is entitled Coin-Handling Device, which bears Ser. No. 469,108, and which was filed on May 13, 1974. A gear-type electric motor 22 is mounted on that base, and it rotates a coin-receiving drum 46. Rollers 40 and 44 can guide that coin-receiving drum into position to be rotated by the motor 22, and rollers 42 help support that coin-receiving drum while it is being rotated. A coin-guiding chute 34 receives coins which issue from the coin-receiving drum 46, and it guides those coins toward the coin-holding tube 70 of a coin-dispensing unit 38. A resilient collar 73 encircles the coin-holding tube 70, and that collar supports a level-sensing unit which is generally denoted by the numeral 74. The motor 22, the coin-guiding chute 34, the coin-dispensing unit 38, the rollers 40, 42, and 44, and the coin-receiving drum 46 preferably are identical to the similarly-numbered components of the said Erickson application. The resilient collar 73 preferably is identical to the similarly-numbered collar in Raymond A. Johnson application Ser. No. 490,133 which is entitled Coin-Dispensing Device and which was filed on July 19, 1974.

The level-sensing unit 74 has a generally U-shaped body 75, as indicated particularly by FIG. 3; and a light source 76, such as a light-emitting diode, is mounted in one arm of that U-shaped body, while a light sensing element 78, such as a phototransistor, is mounted in the other arm of that U-shaped body. A generally U-shaped closure 77 has the closed end thereof closing the open end of the generally U-shaped body 75; and the arms of that generally U-shaped closure close the open sides of that generally U-shaped body. A pivot 80 is mounted in the generally U-shaped closure 77; and that pivot rotatably supports a light-impervious vane 82 which has an actuator 84. That vane and that actuator are balanced so that actuator will enter the coin-holding tube 70 whenever the uppermost coin in that Coin-holding tube is below the level of the path of that actuator. Whenever the actuator 84 enters the coin-holding tube 70, the vane 82 will be below the level of the light source 76, as shown by FIG. 2; and hence the light from that light source will be able to pass to the light sensing element 78. However, that vane will be in register with, and will block the light from, the light source 76 whenever enough coins are held within the coin-holding tube 70 to hold the actuator 84 out of that coin-holding tube.

Referring particularly to FIG. 4, the numeral 86 denotes a filter which has the input thereof connected to the junction between the collector of the grounded-emitter NPN phototransistor 78 and a resistor 79. That filter can be of standard and usual design; and it is intended to filter out any noise, transients and undesired signals which may emanate from the source of power to which the upper terminal of resistor 79 is connected. The upper terminal of the light source 76 is connected to that source of power by a resistor, as shown by FIG. 4; and the lower terminal of that light source is grounded. The output of filter 86 is connected to the upper input of a NOR gate 88; and the output of that NOR gate is connected by a junction 90 to the input of a relay driver 92 and to the input of an inverter 100.

That relay driver can be of standard and usual design; and it is shown as including a resistor which is connected to the base of a grounded-emitter NPN transistor that has the collector thereof connected to a source of plus 24 volts by a relay coil 94. A discharge diode is connected in parallel with that relay coil; and that relay coil controls normally-open relay contacts 96. One of those relay contacts is connected to a suitable source of power, such as a source of 120 volts, 60 hertz alternating current, by a conductor 98; while the other of those relay contacts is connected to the other side of that source of power by the motor 22.

The output of inverter 100 is connected to the upper input of a NAND gate 104; and a junction 106 connects the output of that NAND gate to the upper input of a NAND gate 108 and also to the upper input of a NAND gate 114. A conductor 109 connects the lower input of the NAND gate 114 to a manually-operated re-set device, not shown. The output of NAND gate 108 is connected to the input of an astable multivibrator 110 of standard and usual design. The astable multivibrator 110 includes a NOR gate, two inverters, two resistors, and a capacitor.

The numeral 112 denotes a counter; and, although different counters could be used, the counter 112 has been found to be very useful. That counter includes a Motorola 4015 dual four-stage static shift register 111, a Motorola 4013 dual D-type flip-flop 113 and 115, an inverter 117, a NOR gate 119, a NAND gate 121, and a resistor 123. The out-put of the astable multivibrator 110 is connected to the clock input of the shift register 111; and the output of the NAND gate 114 is connected to the reset inputs of that shift register and of the flip-flops 113 and 115. The $Q_2$ output of the shift register 111 is connected to the left-hand input of NOR gate 119; and the $Q_4$ output of that shift register is connected to the clock input of flip-flop 113 and to the input of inverter 117. The output of that inverter is connected to the right-hand input of NOR gate 119 and to the Data input of shift register 111. The $Q_5$ output of flip-flop 113 is connected to the clock input of flip-flop 115; and the $Q_6$ output of the former flip-flop is connected to the Data input of that flip-flop and also to the middle input of NAND gate 121. The $Q_8$ output of flip-flop 115 is connected to the Data input of that flip-flop and also to the right-hand input of NAND gate 121. The Set inputs of flip-flops 113 and 115 are connected together and are connected to ground by the resistor 123.

The output of the NOR gate 119 of the counter 112 is connected to the left-hand of the NAND gate 121 and, by a conductor 101, to the input of an inverter 102 and also to the lower input of the NOR gate 88. The output of the inverter 102 is connected to the lower input of the NAND gate 104.

The output of the NAND gate 121 of the counter 112 is connected to the lower input of the NAND gate 108, and also to the input of an inverter 118. The output of that inverter is connected to the input of a relay driver 120 which includes a resistor that is connected to the base of a grounded-emitter NPN transistor which has the collector thereof connected to the source of plus 24 volts by a relay coil 122. A discharge diode is connected in parallel with that relay coil; and that relay coil controls normally-open relay contacts 124. Those relay contacts will be connected to an "empty lamp", not shown, in the coin-dispensing machine of which the coin-dispensing unit 38 is a part.

Referring particularly to FIG. 5, the numeral 128 denotes the wave form at the output of the filter 86, and the numeral 130 denotes the wave form which is applied to the conductor 101 by the counter 112. The numeral 134 denotes the wave form at the output of the NOR gate 88, and the numeral 138 denotes the wave form at the output of NAND gate 104. The numeral 140 denotes the wave form at the junction 116, and the numeral 142 denotes the wave form at the output of the NAND gate 108. The numeral 143 denotes the wave form at the output of the astable multivibrator 110; and that wave form includes fixed frequency positive-going pulses 144. In one preferred embodiment of the present invention, the pulses 144 are developed at the rate of one every 3 seconds. The numeral 132 denotes positive-going pulses of the wave form 130; and each of those pulses has a duration of 6 seconds, and those pulses are spaced apart by 18 second intervals. The numeral 136 denotes negative-going pulses of the wave form 134; and each of those pulses has a duration of 6 seconds, and those pulses are spaced apart by 18 second intervals.

When the coin-holding tube 70 of the coin-dispensing unit 38 is full, the coins within that coin-holding tube will engage the actuator 84, and will thereby hold that actuator outwardly of that coin-holding tube. As a result, the vane 82 will be in position to keep light emitted by the light source 76 from reaching the photo transistor 78. Consequently, that photo transistor will appear as a large resistance; and a logic one will be applied to the upper input of the NOR gate 88 by the filter 86, as indicated by left-hand end of the wave form 128 in FIG. 5. That NOR gate will respond to the logic one at the upper input thereof to develop a logic zero at the output thereof, as indicated by the left-hand end of the wave form 134 in FIG. 5, and hence at the base of the transistor in the relay driver 92. All of this means that whenever the coil-holding tube 70 of the coin-dispensing unit 38 is full, essentially no current will flow through the relay coil 94; and hence the relay contacts 96 will be open, and the motor 22 will be de-energized.

The logic zero at the output of NOR gate 88 will be applied to the input of inverter 100; and that inverter will apply a logic one to the upper input of NAND gate 104. The $Q_6$ and $Q_8$ outputs, respectively, of the flip-flops 113 and 115 in the counter 112 will be applying logic zero to the midddle and right-hand inputs of NAND gate 121. The NOR gate 119 in the counter 112 will be applying logic zero to the left-hand input of the NAND gate 121, to the input of inverter 102, and to the lower input of NOR gate 88, all as indicated by the left-hand end of the wave form 130 in FIG. 5. That logic zero will not affect the output of NOR gate 88; but it will cause the inverter 102 to apply a logic one to the lower input of NAND gate 104, and it will help cause NAND gate 121 to apply a logic one to the lower input of NAND gate 108 and to the input of inverter 118, as indicated by the left-hand end of the wave form 140 in FIG, 5. The logic ones at the two inputs of NAND gate 104 will cause that NAND gate to apply logic zero to the upper input of NAND gate 108 and to the upper input of NAND gate 114, as indicated by the left-hand end of the wave form 138 in FIG. 5. NAND gate 108 will apply a logic one to the input of the astable multivibrator 110 as indicated by the left-hand end of the wave form 142 in FIG. 5; and that logic one will keep that astable multivibrator from producing pulses, as indicated by the left-hand end of the wave form 143 in FIG. 5. The manually-operated re-set device, not shown, to which the lower input of NAND gate 114 is connected by the conductor 109, normally applies a logic one to that lower input. That NAND gate will apply a logic one to the reset inputs of shift register 111 and of flip-flops 113 and 115; and hence the counter 112 will be held at rest. The inverter 118 will respond to the logic one at the input thereof to apply logic zero to the base of the transistor in the relay driver 120; and the resulting non-conduction of that registor will keep the relay coil 122 de-energized. The overall result is that as long as the coins within the coin-handling tube 70 hold the vane 82 in position between the light source 76 and the photo-transistor 78, the relay contacts 96 will be open and will hold the motor 22 de-energized, the astable multivibrator 110 and the counter 112 will be at rest, and the relay contacts 124 will be open.

Whenever the coin-dispensing unit 38 is caused to dispense enough coins to permit the uppermost coin in the coin-holding tube 70 to move downwardly out of the path of the actuator 84, gravity will cause that actuator to move into the position shown by FIG. 2. At such time, the light from the light source 76 will pass to the photo-transistor 78 and will render that photo transistor conductive. Thereupon, the logic one at the upper input of NOR gate 88 will become logic zero, as indicated by the wave form 128 in FIG. 5; and logic zero will continue to appear at that upper input as long as the vane 82 remains in the position shown by FIG. 2. The resulting logic one at the output of NOR gate 88 as indicated by the wave form 134 in FIG. 5; and that logic one will render the transistor of the relay driver 92 conductive. The consequent flow of current through the relay coil 94 will close the relay contacts 96; and, thereupon, the motor 22 will start rotating the coin-receiving drum 46 in FIG. 1.

The logic one at the output of NOR gate 88 will cause inverter 100 to apply logic zero to the upper input of NAND gate 104; and the resulting logic one at the output of that NAND gate is indicated by the wave form 138 in FIG. 5. That logic one will be applied to the upper input of NAND gate 108; and that NAND gate will change the logic one at the output thereof to logic zero, as indicated by wave form 142 in FIG. 5. The astable multivibrator 110 will respond to that logic zero to start developing the pulses 144, as indicated by wave form 143 in FIG. 5. The logic one at the output of NAND gate 104 also will be applied to the upper input of NAND gate 114; and, because a logic one normally is applied to the lower input of that NAND gate by conductor 109 and by the manually-operated re-set device, not shown, the consequent logic zero at the output of that NAND gate will enable the shift register 111 to respond to the pulses 144 from the astable multivibrator 110 and to signals from the inverter 117. The logic zero at the output of the NAND gate 114 also will enable the flip-flops 113 and 115 to respond to clocking signals and to data signals applied thereto. As a result, the counter 112 will start counting the pulses 144 from the astable multivibrator 110.

After the counter 112 has counter six of the pulses 114, it will change the logic zero at the output of NOR gate 119 to a logic one and thereby produce the leading edge of the left-handmost pulse 132 of the wave form 130 in FIG. 5. Thereupon, the NOR gate 88 will respond to the logic one at the lower input thereof to produce the leading edge of the left-handmost pulse 136 of the wave form 134 in FIG. 5; and the inverter 102 will respond to the logic one at the input thereof to apply logic zero to the lower input of NAND gate 104. The leading edge of the left-handmost pulse 136 will render the transistor of relay driver 92 non-conductive, and thus will permit the relay coil 94 to become de-energized—with consequent re-opening of relay contacts 96 and with consequent de-enerigization of the motor 22. That left-handmost pulse will cause inverter 100 to apply a logic one to the upper input of NAND gate 104; but the logic zero at the lower input of that NAND gate will cause that NAND gate to continue to apply a logic one to the upper input of NAND gate 108, as indicated by the wave form 138 in FIG. 5. The latter NAND gate will continue to have a logic one applied to the lower input thereof; as shown by wave form 140 of FIG. 5; and hence that latter NAND gate will continue to apply logic zero to the input of the estable multivibrator 110, as shown by wave form 142 in FIG. 5. The overall result is that the astable multivibrator will continue to develop the pulses 144 of the wave form 143 in FIG. 5.

The logic one at the output of NOR gate 119 will be applied to the left-hand input of NAND gate 121. However, because logic zero will continue to be applied to the middle and right-hand inputs of that NAND gate, that NAND gate will continue to apply logic one to the lower input of NAND gate 108 and to the input of inverter 118. The consequent logic zero at the base of the transistor in the relay driver 120 will leave that transistor non-conductive—with consequent continued de-energization of relay coil 122. The continued logic one at the output of NAND gate 104 will cause the NAND gate 114 to continue to apply logic zero to the reset inputs of shift register 111 and of flip-flops 113 and 115; and hence the counter 112 will be permitted to count the pulses 144 from the astable multivibrator 110.

The counter 112 will, after two additional pulses 144 make the total number of counted pulses equal eight, cause NOR gate 119 to change the logic one on conductor 101 back to logic zero, as shown by the trailing edge of the left-handmost pulse 132 of the wave form 130 in FIG. 5. The NOR gate 88 will respond to the resulting logic zero at the lower input thereof to change the logic zero at the output thereof to a logic one, as shown by the trailing edge of the left-handmost pulse 136 of the wave form 134 in FIG. 5. Thereupon, the transistor of the relay driver 92 will again become conductive—with consequent energization of relay coil 94 and with consequent re-energization of motor 22. The logic zero which NOR gate 119 applies to the left-hand input of NAND gate 121 will not change the logic one at the output of that NAND gate, as shown by wave form 140 in FIG. 5; hence the inverter 118 will continue to keep the relay driver 120 de-energized by continuing to apply logic zero thereto. The logic zero at the input of inverter 102 will cause that inverter to apply a logic one to the lower input of NAND gate 104; but the inverter 100 will respond to the logic one from NOR gate 88 to apply logic zero to the upper input of that NAND gate. As a result, that NAND gate will continue to have logic one at the output thereof, as shown by wave form 138 in FIG. 5. The consequent continuing logic one at the upper input of NAND gate 108 will coact with the continuing logic one at the lower input of that NAND gate to enable that NAND gate to continue to apply logic zero to the input of the astable multivibrator 110, as shown by wave form 142 in FIG. 5.

The overall results are renewed rotation of the coin-receiving drum 46 in FIG. 1 by the motor 22, and continued counting by the counter 112 of the pulses 144 from the astable multivibrator 110. That counter will, after six further pulses 144 make the total number of counted pulses equal fourteen, again cause a logic one to appear at the output of NOR gate 119 in that counter, as shown by the leading edge of the second pulse 132 of wave form 130 in FIG. 5. In the manner described hereinbefore, in connection with the development of a logic one at that output after the sixth pulse 144, the motor 22 will again be de-energized but the counter 112 will continue to count. That counter will, after two further pulses 144 make the total number of counted pulses equal sixteen, again cause logic zero to appear at the output of NOR gate 119 in that counter, as shown by the trailing edge of the second pulse 132 of wave form 130 in FIG. 5. In the manner described hereinbefore, in connection with the development of logic zero at that output after the eighth pulse 144, the motor will again be energized and the counter 112 will continue to count.

The counter 112 will, after six further pulses 144 make the total number of counted pulses equal twenty-two, again cause a logic one to appear at the output of NOR gate 119 in that counter, as shown by the leading edge of the third pulse 132 of wave form 130 in FIG. 5. In the manner described hereinbefore, in connection with the development of a logic one at that output after the sixth pulse 144, the motor 22 will again be de-energized but the counter 112 will continue to count. That counter will, after two further pulses 144 make the total number of counted pulses equal twenty-four, again cause logic zero to appear at the output of NOR gate 119 in that counter, as shown by the trailing edge of the third pulse 132 of wave form 130 in FIG. 5. In the manner described hereinbefore, in connection with the development of logic zero at that output after the eighth pulse 144, the motor will again be energized and the counter 112 will continue to count.

The counter 112 will, after six further pulses 144 make the total number of counted pulses equal thirty, again cause a logic one to appear at the output of NOR gate 119 in that counter, as shown by the leading edge of the continuous pulse 132 at the right-hand end of the wave form 130 in FIG. 5. In the manner described hereinbefore, in connection with the development of a logic one at that output after the sixth pulse 144, the motor 22 will again be de-energized. However, at such time, the $Q_6$ and $Q_8$ ouputs, respectively, of the flip-flops 113 and 115 will be applying logic ones to the middle and right-hand inputs of NAND gate 121. Consequently, that NAND gates will apply logic zero at the lower input of NAND gate 108 and to the input of inverter 118. The latter NAND gate will apply a logic one to the input of the astable multivibrator 110, and will thereby halt further generation of the pulses 144, as shown by the right-hand end of the wave form 143 in FIG. 5. The inverter 118 will apply a logic one to the base of the transistor of the relay driver 120 — with consequent energization of relay coil 122 and with consequent closing of relay contacts 124. Because the astable multivibrator 110 will be kept from developing any further pulses 144, the counter 112 will cause NOR gate 119 to develop a continuous logic one at the outputs thereof, and will cause NAND gate 121 to develop a continuous logic zero at the output thereof. The continuous logic one at the output of NOR gate 119 will act through NOR gate 88, relay driver 92, relay coil 94 and relay contacts 96 to keep the motor 22 continuously de-energized; and the continuous logic zero at the output of NAND gate 121 will act through inverter 118, relay driver 120, and relay coil 122 to keep the relay contacts 124 closed continuously. As a result, the motor 22 is kept from "running" continuously, and the contacts 124 will close a circuit which will indicate that the coin-holding tube 70 of the coin-dispensing unit 38 remains empty.

One coin-receiving drum 46, with which the preferred circuit of the present invention is used, has ten coin-receiving recesses therein, and the motor 22 rotates that coin-receiving drum at the rate of 16½ revolutions per minute. This means that unless the coins within that coin-receiving drum have "bridged" or have otherwise interacted to prevent the free release of coins from that coin-receiving drum, coins will be released from that coin-receiving drum at a rate in excess of two coins per second.

The actuator 84 will move into the coin-holding tube 70 as soon as the uppermost coin in that coin-holding tube moves downwardly below the path of that actuator; but that actuator will be held out of that coin-holding tube as soon as the uppermost coin within that coin-holding tube blocks the path of movement of that actuator. The coin-dispensing unit 38 will seldom, if ever, be required to dispense more than ten coins during any one transaction in which that coin-dispensing unit is actuated; and hence, unless the coins in the coin-receiving drum 46 have "bridged" or have otherwise interacted to impede the free release of coins from that coin-receiving drum, the coin-holding tube 70 will be re-filled, and the actuator 86 will be held out of that coin-holding tube, before the motor 22 has operated a total of 5 seconds. Consequently, during normal operation of the coin-receiving drum 46, enough coins will exit from that coin-receiving drum to re-fill the coin-holding tube 70 before the counter 112 counts the 15 seconds represented by the first five pulses 144 of the wave form 143 in FIG. 5. As those coins re-fill that coin-holding tube, the logic one at the upper input of NOR gate 88 will act through that NOR gate, the inverter 100, NAND gate 104, and NAND gate 114 to apply a logic one to the Reset inputs of shift register 111 and of flip-flops 113 and 115. Consequently, any counts which were counted and stored in the counter 112, while the motor 22 was rotating the coin-receiving drum 46, will be erased. All of this means that as long as the coin-receiving drum 46 releases coins in its intended manner and at its intended rate, the circuit provided by the present invention will permit the level-sensing unit 38 to control the energizations and de-energizations of the motor 22—and hence the durations of the rotations of that coin-receiving drum.

If, at any time and for any reason— including total depletion of the supply of coins in the coin-receiving drum 46, the resulting logic one at the lower input of the NOR gate 88 will cause the relay driver 92, the relay coil 94, and the relay contacts 96 to de-energize the motor 22, that motor will remain de-energized for 6 seconds, and then will be re-energized for 18 seconds or until the actuator 84 is moved out of the coin-holding tube 70 — whichever occurs first in point of time. If, at the end of that 18 second period, that actuator is still within that coin-holding tube, the motor 22 will be de-energized for a second 6 second period and then will be re-energized for a second 18 second period or until the actuator 84 is moved out of the coin-holding tube 70 — whichever occurs first in point of time. If, at the end of that second 18 second period, the actuator 84 is still within the coin-holding tube 70, the motor 22 will be de-energized for a third 6 second period and then will be re-energized for a third 18 second period or until the actuator 84 is moved out of the coin-holding tube 70 — whichever occurs first in point of time. If, at the end of that third 18 second period, that actuator is still within that coin-holding tube, a logic one will appear at the output of NOR gate 119; and logic ones will appear at the $Q_6$ and $Q_8$ outputs, respectively, of flip-flops 113 and 115. That NOR gate will cause NOR gate 88 to de-energize the motor 22; and NAND gate 121 will cause the astable multivibrator 110 to halt further generation of the pulses 144, and also will cause the relay contacts 124 to close. This means that the motor 22 will be maintained de-energized, and that the relay contacts 124 will provide a signal showing that the coin-holding tube 70 is empty.

After a service man has introduced a quantity of coins into the coin-receiving drum 46, and also has introduced enough coins into the coin-holding tube 70 to move the actuator 84 out of that coin-handling tube, he will momentarily actuate the manually-operated re-set device, not shown, to apply a momentary logic zero to the lower input of NAND gate 119. The resulting momentary logic one at the output of that NAND gate will re-set the shift register 111 and the flip-flops 113 and 115. Thereupon, any previously-registered counts within the counter 112 will be erased; and the outputs of NOR gate 119 and the $Q_6$ and $Q_8$ outputs of the flip-flops 113 and 115 will become logic zeroes. At such time, the logic one from the level-sensing unit 74 will cause both the motor 82 and the relay coil 122 to be de-energized, and the multivibrator 110 will not be generating, and the counter 112 will not be counting, pulses.

Each time the motor 22 is energized, the frictional engagements between the coins in the coin-receiving drum 46 will tend to cause the center of gravity of the mass of these various coins to shift in the direction of rotation of that coin-receiving drum as that coin-receiving drum rotates. Each time that motor is de-energized, gravity will tend to cause the center of gravity of that mass of coins to return to its original position as the coin-receiving drum 46 is brought to rest by the braking effect of that motor. All of this means that the coins will tend to shift relative to the coin-receiving drum 46 whenever the motor 22 is energized or de-energized. Moreover, if the mounting and driving arrangement for the coin-receiving drum 56 is identical to the corresponding mounting and driving arrangement of the said Erickson application, that coin-receiving drum will rotate in the reverse direction whenever the motor 22 is de-energized — because the coins at one side of that coin-receiving drum will rise above the level of the coins at the other side while that motor is operating, and because gravity will tend to rotate that coin-receiving drum in the reverse direction until the coin levels at both sides are the same. If the coin-receiving drum 46 is full, that reverse rotation can be as much as 15°. However, any reverse rotation of the coin-receiving drum 46 will cause the coins therein to tend to shift; and any and all shifting of those coins relative to that coin-receiving drum will tend to eliminate any "bridging" or other impedance to the ready discharging of coins from that coin-receiving drum. As a result, most "bridgings" or other impediments to the free release of coins from the coin-receiving drum 46 will automatically clear after one, two, or three de-energizations and energizations of the motor 22. If, however, a "bridge" or other impediment to the ready discharging of coins from the coin-receiving drum 46 develops and continuously prevents or retards the release of coins from that coin-receiving drum, the circuit of the present invention will respond to the resulting continuous logic zero at the upper input of NOR gate 88 to energize the motor 22 for 15 seconds, to de-energize that motor for 6 seconds, to re-energize that motor for 18 seconds, to de-energize that motor for a second 6 seconds, re-energize that motor for a second 18 seconds, to de-energize that motor for a third 6 seconds, to re-energize that motor for a third 18 seconds, and to de-energize that motor. At the end of the third 18 second energization of the motor 22, the contacts 124 will cause a suitable indication of the empty condition of the coin-holding tube 70 to be given. In this way, prolonged operation of the motor 22 is avoided, and prompt notification of the empty state of the coin-holding tube 70 is provided.

If desired, a solenoid or other electromagnetic device could be mounted adjacent the coin-receiving drum 46 so it would not interfere with any normal forward and reverse rotation of that coin-receiving drum but would cause a force to be applied to that coin-receiving drum a few milliseconds after the motor 22 was de-energized. If such a force was directed axially or radially of that coin-receiving drum, it would tend to cause the coins within that coin-receiving drum to shift, and thereby would tend to terminate any "bridging" or blocking of the coin exit for that coin-receiving drum. If such a force was directed circumferentially of the coin-receiving drum 46, it could also provide additional reverse rotation of that coin-receiving drum, and could thereby increase the likelihood that any "bridging" or blocking of the coin exit would terminate.

Any reverse rotation of the coin-receiving drum 46, whether aided or unaided, which occurs when the motor 22 is de-energized is desirable. Not only does such reverse rotation tend to cause the coins within that coin-receiving drum to shift relative to that coin-receiving drum, but it reduces the torque load which the motor 22 must overcome when that motor is re-energized. In additionn, such reverse rotation can "back" the "bridging" or blocking coins away from the coin exit for the coin-receiving drum 46; and then the impact of those coins against that coin exit, during the ensuing forward rotation of those coins, will have a good chance of terminating the "bridging" or blocking of those coins.

In the preferred embodiment of coin-dispensing unit 38 shown in the drawing, about twenty-eight dimes are needed to hold the actuator 84 out of the coin-holding tube 70. However, that coin-holding tube can be made to accommodate larger coins, and also can be made to accommodate more or fewer coins.

The coin-receiving drum 46 can be considered to be a coin-receiving reservoir, and the mounting and driving arrangement shown in the drawing permits quick and easy separation of that coin-receiving drum from that mounting and driving arrangement. As a result, such a mounting and driving arrangement is desirable. However, the circuit provided by the present invention is usable with coin-receiving reservoirs, in the form of coin-receiving drums or otherwise, which are not readily separable from the mounting and driving arrangements therefor. In fact, that circuit is usable with coin-receiving reservoirs which are permanently secured to the mounting and driving arrangements therefor.

Whereas the drawing and accompanying description have shown and described a preferred embodiment of the present invention, it should be apparent to those skilled in the art that various changes can be made in the form of the invention without affecting the scope thereof.

What I claim is:

1. Circuitry for a coin-dispensing system which comprises a coin-receiving reservoir that can hold coins therein and that can be rotated in a predetermined direction to cause said coins to issue therefrom, an electric motor that can be energized to rotate said coin-receiving reservoir in said predetermined direction but that can be de-energized to permit said coin-receiving reservoir to come to rest, a coin-holding tube that can receive and hold coins which issue from said coin-receiving reservoir, a level-sensing device for said coin-holding tube which develops a call for energization of said electric motor whenever the endmost coin within said coin-holding tube reaches a predetermined level, and control means that responds to said call from said level-sensing device to energize said electric motor, said control means including a subcircuit which initiates a pre-set time period during said call from said level sensing device, said control means providing a predetermined programmed plurality of energizations and de-energizations of said electric motor, said control means providing said predetermined programmed plurality of energizations and de-energizations of said electric motor throughout the duration of said call from said level-sensing device whenever said duration of said call from said level-sensing device is shorter than said pre-set time period, said control means providing said predetermined programmed plurality of energizations and de-energizations of said electric motor throughout said pre-set time period whenever said duration of said call from said level-sensing device equals said pre-set time period.

2. Circuitry as claimed in claim 1 wherein said control means will, at the end of said pre-set time period wherein said predetermined programmed plurality of energizations and de-energizations of said electric motor have occurred, maintain said electric motor continuously de-energized until said circuitry is re-set.

3. Circuitry as claimed in claim 1 wherein said electric motor permits said coin-receiving reservoir to rotate a short distance in the opposite direction when said electric motor is de-energized.

4. Circuitry as claimed in claim 1 wherein said electric motor permits said coin-receiving reservoir to rotate a short distance in the opposite direction when said electric motor is de-energized, and wherein alternating rotations of said coin-receiving reservoir in said predetermined direction and in said opposite direction apply oppositely-direction forces to any impediment to the issuance of coins from said coin-receiving reservoir.

5. Circuitry as claimed in claim 1 wherein a signalling means develops an electrical signal at the end of said predetermined programmed plurality of energizations and de-energizations of said electric motor to indicate that coins are not issuing from said coin-receiving reservoir and that said coin-handling tube is not filled.

6. Circuitry as claimed in claim 1 wherein said control means effectively isolates said call, from said level-sensing device, from said electric motor to effect said de-energizations of said electric motor.

7. Circuitry as claimed in claim 1 wherein said coin-receiving can, in the absence of an impediment to the issuance of coins therefrom, replenish the supply of coins in said coin-holding tube prior to the end of said predetermined programmed plurality of energizations and de-energizations of said electric motor, whereby said level-sensing device normally determines the time period during which the energizations and de-energizations of said electric motor occur.

8. Circuitry for a dispensing system which comprises a reservoir that can hold dispensable items therein and that can be moved in a predetermined direction to cause said dispensable items to issue therefrom, a source of motive power that can be energized to move said reservoir in said predetermined direction but that can be de-energized to permit said reservoir to come to rest, a signal source that selectively calls for energization of said source of motive power, and control means that responds to a call from said signal source to energize said source of motive power, said control means including a subcircuit which initiates a pre-set time period during said call from said signal source, said control means providing a predetermined programmed plurality of energizations and de-energizations of said source of motive power, said control means providing said predetermined programmed plurality of energizations and de-energizations of said source of motive power throughout the duration of said call from said signal source whenever said duration of said call from said signal source is shorter than said pre-set time period, said control means providing said predetermined programmed plurality of energizations and de-energizations of said source of motive power throughout said pre-set time period whenever said duration of said call from said signal source equals said pre-set time period.

9. Circuitry as claimed in claim 8 wherein said control means effectively isolates said call, from said signal source, from said source of motive power to effect said de-energizations of said source of power.

10. Circuitry as claimed in claim 8 wherein said source of power is an electric motor which responds to each energization thereof to rotate said reservoir in said predetermined direction, and wherein said source of power permits said reservoir to rotate a short distance in the opposite direction when said source of power is de-energized.

11. Circuitry as claimed in claim 8 wherein said source of power permits said reservoir to move a short distance in the opposite direction when said source of power is de-energized, and wherein alternating movements of said reservoir in said predetermined direction and in said opposite direction apply oppositely-directed forces to any impediment to the issuance of dispensable items from said reservoir.

12. Circuitry as claimed in claim 8 wherein said signal source is a level-sensing device for a dispensing unit, and wherein said reservoir can, in the absence of an impediment to the issuance of dispensable items therefrom, replenish the supply of dispensable items in said dispensing unit prior to the end of said predetermined programmed plurality of energizations and de-energizations of said source of motive power, whereby said signal source normally determines the energizations and de-energizations of said source of motive power.

13. Circuitry as claimed in claim 8 wherein a signalling means develops an electrical signal at the end of said predetermined programmed plurality of energizations and de-energizations of said source of motive power to indicate that said dispensable items are not issuing from said reservoir.

14. Circuitry for a dispensing system which comprises a reservoir that can hold dispensable items therein and that can be moved in a predetermined direction to cause said dispensable items to issue therefrom, a source of motive power than can be energized to move said reservoir in said predetermined direction but that can be de-energized to permit said reservoir to come to rest, a signal source that selectively calls for energization of said source of motive power, and control means that responds to a call from said signal source to energize said source of motive power, said control means providing a predetermined programmed plurality of energizations and de-energizations of said source of motive power, and thereby effecting a corresponding programmed plurality of movements of said reservoir in said pre-determined direction, said control means providing said predetermined programmed plurality of energizations and de-energizations of said electric motor during said call even though said call is continuous and un-interrupted.

15. Circuitry as claimed in claim 14 wherein said control means will, at the end of said predetermined programmed plurality of energizations and de-energizations of said source of motive power, maintain said source of power continuously de-energized until said circuitry is re-set.

16. Circuitry as claimed in claim 14 wherein said source of motive power is an electric motor which responds to each energization thereof to rotate said reservoir in said predetermined direction, and wherein said source of motive power permits said reservoir to rotate a short distance in the opposite direction when said source of power is de-energized.

17. Circuitry as claimed in claim 14 wherein said source of motive power permits said reservoir to move a short distance in the opposite direction when said source of motive power is de-energized, and wherein alternating movements of said reservoir in said predetermined direction and in said opposite direction apply oppositely-directed forces to any impediment to the issuance of dispensable items from said reservoir.

18. Circuitry as claimed in claim 14 wherein a signalling means develops an electrical signal at the end of said predetermined programmed plurality of energizations and de-energizations of said source of motive power to indicate that said dispensable items are not issuing from said reservoir.

19. Circuitry as claimed in claim 10 wherein said reservoir is a coin reservoir, wherein said dispensable items are coins, wherein said signal source is a level-sensing device for a coin-holding tube, and wherein coins issuing from said reservoir are directed to said coin-holding tube.

20. Circuitry for a dispensing system which comprises a reservoir that can hold dispensable items therein and that can be moved in a predetermined direction to cause said dispensable items to issue therefrom, a source of motive power that can be energized to move said reservoir in said predetermined direction but that can be de-energized to permit said reservoir to come to rest, a signal source that selectively calls for energization of said source of motive power, control means that responds to a call from said signal source to energize said source of motive power, means including a subcircuit which initiates a pre-set time period during said call from said signal source, said control means providing a predetermined programmed plurality of energizations and de-energizations of said source of motive power, said control means providing said predetermined programmed plurality of energizations and de-energizations of said source of motive power throughout the duration of said call from said signal source whenever said duration of said call from said signal source is shorter than said pre-set time period, said control means providing said predetermined programmed plurality of energizations and de-energizations of said source of motive power throughout said pre-set time period whenever said duration of said call from said signal source equals said pre-set time period, said control means including a pulse source and a counter which counts pulses from said pulse source, and said control means acting, whenever said counter counts a predetermined number of pulses from said pulse source, to maintain said source of power continuously de-energized until said circuitry is re-set.

21. Circuitry for a coin-dispensing system which comprises a coin-receiving reservoir that can hold coins therein and that can be rotated in a predetermined direction to cause said coins to issue therefrom, an electric motor that can be energized to rotate said coin-receiving reservoir in said predetermined direction but that can be de-energized to permit said coin-receiving reservoir to come to rest, a coin-holding tube that can receive and hold coins which issue from said coin-receiving reservoir, a level-sensing device for said coin-holding tube which develops a call for energization of said electric motor whenever the endmost coin within said coin-holding tube reaches a predetermined level, control means that responds to said call from said level-sensing device to energize said electric motor, said control means including a subcircuit which initiates a pre-set time period during said call from said level sensing device, said control means providing a predetermined programmed plurality of energizations and de-energizations of said electric motor, said control means providing said predetermined programmed plurality of energizations and de-energizations of said electric motor throughout the duration of said call from said level-sensing device whenever said duration of said call from said level-sensing device is shorter than said pre-set time period, said control period, said control means providing said predetermined programmed plurality of energizations and de-energizations of said electric motor throughout said pre-set time period whenever said duration of said call from said level-sensing device equals said pre-set time period said control means including a pulse source and a counter which counts pulses from said pulse source, and said control means acting, whenever said counter counts a predetermined number of pulses from said pulse source, to maintain said electric motor continuously de-energized until said circuitry is re-set.

* * * * *